US009669518B2

(12) United States Patent
Feng et al.

(10) Patent No.: US 9,669,518 B2
(45) Date of Patent: Jun. 6, 2017

(54) POLISHING PAD AND METHOD FOR MAKING THE SAME

(71) Applicant: San Fang Chemical Industry Co., Ltd., Kaohsiung (TW)

(72) Inventors: Chung-Chih Feng, Kaohsiung (TW); I-Peng Yao, Kaohsiung (TW); Wen-Chieh Wu, Kaohsiung (TW); Yung-Chang Hung, Kaohsiung (TW)

(73) Assignee: San Fang Chemical Industry Co., Ltd., Kaohsiung (TW)

( * ) Notice: Subject to any disclaimer, the term of this patent is extended or adjusted under 35 U.S.C. 154(b) by 118 days.

(21) Appl. No.: 14/468,621

(22) Filed: Aug. 26, 2014

(65) Prior Publication Data

US 2015/0099439 A1 Apr. 9, 2015

(30) Foreign Application Priority Data

Oct. 3, 2013 (TW) ..... 102135771 A

(51) Int. Cl.

| | |
|---|---|
| ***B24D 3/32*** | (2006.01) |
| ***B24D 11/00*** | (2006.01) |
| ***B24B 37/24*** | (2012.01) |

(52) U.S. Cl.

CPC ..... *B24D 3/32* (2013.01); *B24B 37/24* (2013.01); *B24D 11/00* (2013.01); *B24D 11/001* (2013.01); *B24D 11/006* (2013.01)

(58) Field of Classification Search

CPC ..... B24D 3/32; B24D 11/00; B24D 11/001; B24D 11/003; B24D 11/006; B24B 37/24

(Continued)

(56) References Cited

U.S. PATENT DOCUMENTS 5,396,737 A * 3/1995 Englund ..... B24D 13/14 451/28
6,468,911 B1 * 10/2002 Miyashita ..... B24B 37/044 216/38

(Continued)

FOREIGN PATENT DOCUMENTS

CN 1891406 A 1/2007
CN 101306518 A 11/2008

(Continued)

OTHER PUBLICATIONS

Office action and search report issued on May 25, 2016 by State Intellectual Property Office of China for the counterpart China Patent Application No. 201310549536.4.

(Continued)

*Primary Examiner* — Eileen Morgan
(74) *Attorney, Agent, or Firm* — WPAT, P.C., Intellectual Property Attorneys; Anthony King; Kay Yang

(57) ABSTRACT

The present invention relates to a polishing pad and a method for making the same. The polishing pad has a grinding layer. The grinding layer includes a plurality of fibers and a main body. The fineness of the fibers is 0.001 den to 6 den. The main body is a foam and encloses the fibers. The main body has a plurality of first pores and a plurality of second pores, wherein the first pores are communicated with each other, and the second pores are independent from each other. The size of the first pores is at least 5 times greater than the size of the second pores. The hardness of the grinding layer is 30 to 90 shore D, and the compression ratio thereof is 1% to 10%.

6 Claims, 4 Drawing Sheets

(58) Field of Classification Search
USPC ..... 451/527, 530, 532
See application file for complete search history.

(56) References Cited

U.S. PATENT DOCUMENTS

| | | | | |
|---|---|---|---|---|
| 8,545,291 | B2 * | 10/2013 | Itoyama | B24B 37/24 451/28 |
| 2002/0013122 | A1 * | 1/2002 | Sugaya | B24B 37/26 451/41 |
| 2004/0055223 | A1 * | 3/2004 | Ono | B24B 37/22 51/293 |
| 2005/0255794 | A1 * | 11/2005 | Vangsness | B24B 37/205 451/36 |
| 2006/0270329 | A1 | 11/2006 | Feng et al. | |

FOREIGN PATENT DOCUMENTS

| | | | |
|---|---|---|---|
| CN | 101745876 | A | 6/2010 |
| CN | 102625741 | A | 8/2012 |
| CN | 102639299 | A | 8/2012 |
| CN | 103252729 | A | 8/2013 |
| JP | 2009-078332 | A | 4/2009 |
| TW | 425331 | | 3/2001 |
| TW | 480280 | | 3/2002 |
| TW | 200401357 | A | 1/2004 |
| TW | 1293266 | | 2/2008 |
| TW | I410299 | | 10/2013 |

OTHER PUBLICATIONS

English translation of the search report issued on May 25, 2016 by State Intellectual Property Office of China for the counterpart China Patent Application No. 201310549536.4.
English abstract translation of CN101745876A.
English abstract translation of CN101306518A.
English abstract translation of CN1891406A.
English abstract translation of CN103252729A.
English abstract translation of CN102625741A.
English abstract translation of CN102639299A.
Office action issued on Dec. 15, 2015 by Taiwan Intellectual Property Office for the counterpart Taiwan Patent Application No. 102135771.
Search report issued on Dec. 15, 2015 by Taiwan Intellectual Property Office for the counterpart Taiwan Patent Application No. 102135771.
English translation of the search report issued on Dec. 15, 2015 by Taiwan Intellectual Property Office for the counterpart Taiwan Patent Application No. 102135771.
English abstract translation of TW I410299.
English abstract translation of TW I293266.
English abstract translation of TW 480280.
English abstract translation of TW 425331.
English abstract translation of TW 200401357 A.
English abstract translation of JP 2009-078332 A.

* cited by examiner

POLISHING PAD AND METHOD FOR MAKING THE SAME

BACKGROUND OF THE INVENTION

1. Field of the Invention

The present invention relates to a polishing pad and a method for making the same, and in particular, to a polishing pad having a fiber substrate and a method for making the same.

2. Description of the Related Art

The conventional polishing pad substantially can be divided into two types: a non-woven polishing pad and a separate foam polishing pad. The conventional non-woven polishing pad includes a plurality of fibers and a resin, and the polishing pad is manufactured by using a composite material of the fibers (such as velvet or suede) and the resin, or impregnating a non-woven fabric formed by the fibers in a thermoplastic polyurethane resin for wet coagulation to form a flexible sheet having high deformability formed. A disadvantage of the polishing pad is that the flexibility thereof may easily lead to poor planarization performance of its grinding surface, and the resin cannot uniformly enclose the fibers, that is, a portion of the fibers are not enclosed by the resin, resulting in that the overall strength is insufficient and the service life is shorter.

The conventional separate foam polishing pad includes a plurality of pores and a resin, and the polishing pad is manufactured by pouring the resin (generally a polymer foam of thermoplastic polyurethane) into a cylindrical mold, cooling the resin for coagulation, and then slicing the resin. The polishing pad has higher rigidity than the first conventional non-woven polishing pad, has separate pore structures, and is usually used for high planarization polishing. However, the major problem of the polishing pad is that since it is difficult to achieve uniform distribution of the concentration of the resin in the cylindrical mold, non-uniform temperature distribution at positions in the cylindrical mold during the molding process may lead to different sizes and non-uniform distribution of the pores, which are not easy to be controlled, and as a result, after the slicing process, the difference between the sizes of the pores on the sliced surface of the polishing pad becomes more significant. Moreover, the pores are not in communication with each other, and polishing slurry may not easily flow therebetween in use, and is apt to scratch a workpiece.

Therefore, it is necessary to provide an innovative and progressive polishing pad and a method for making the same, so as to solve the above problems.

SUMMARY OF THE INVENTION

The present invention provides a polishing pad having a grinding layer, the grinding layer including a plurality of fibers and a main body. The fibers cross each other to form a fiber substrate, and the fineness of the fibers is 0.001 den to 6 den. The main body is a foam and encloses the fibers, the main body has a plurality of first pores and a plurality of second pores, the first pores are communicated with each other, the second pores are independent from each other, and the size of the first pores is at least 5 times greater than the size of the second pores, wherein the hardness of the grinding layer is 30 to 90 shore D, and the compression ratio thereof is 1% to 10%.

The present invention further provides a method for making a polishing pad, including the following steps: (a) placing a fiber substrate in a mold, wherein the fiber substrate includes a plurality of fibers, and the fineness of the fibers is 0.001 den to 6 den; (b) injecting a foaming resin in the mold to permeate the fiber substrate and enclose the fibers, wherein the viscosity of the foaming resin is 2000 cps to 5000 cps; and (c) heating to cure the foaming resin, so as to form a grinding layer, the grinding layer including the fiber substrate and a main body, wherein the main body is a foam formed by curing the foaming resin and encloses the fibers, the main body has a plurality of first pores and a plurality of second pores, the first pores are communicated with each other, the second pores are independent from each other, and the size of the first pores is at least 5 times greater than the size of the second pores, wherein the hardness of the grinding layer is 30 to 90 shore D, and the compression ratio thereof is 1% to 10%.

In the present invention, the polishing pad has preferable rigidity and provides high planarization efficiency, which makes it difficult to scratch a polished workpiece, so that the polished workpiece has preferable surface quality, and has a longer service life. Besides, the polishing pad also has preferable stability and reproducibility in the manufacturing process.

BRIEF DESCRIPTION OF THE DRAWINGS

The invention will be described according to the appended drawings in which.

PREFERRED EMBODIMENT OF THE PRESENT INVENTION

Figure 1:
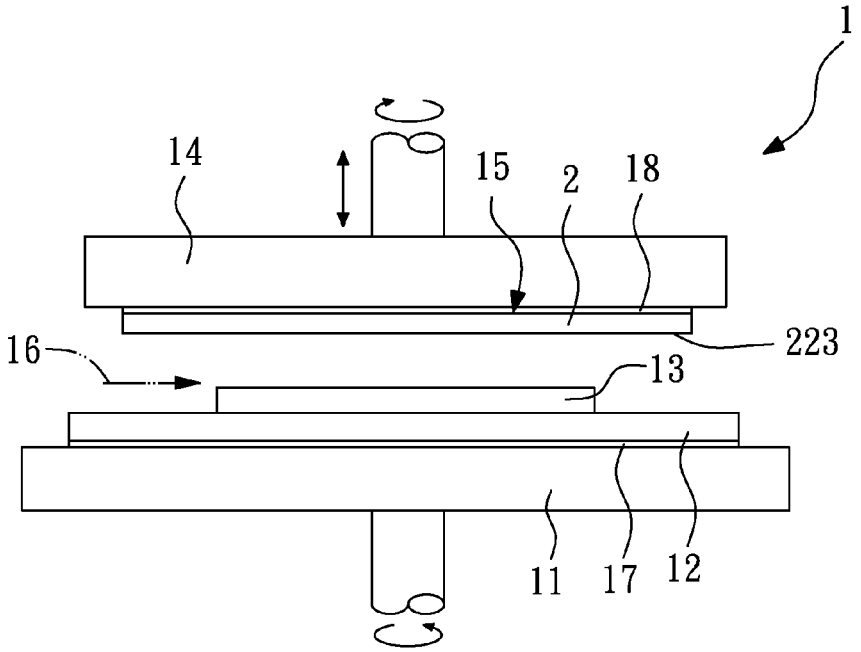
FIG. 1 is a schematic view of a grinding device according to the present invention.

FIG. 1 is a schematic view of a grinding device according to the present invention. The grinding device 1 includes a lower base plate 11, an adsorption sheet 12, a polishing workpiece 13, an upper base plate 14, a polishing pad 15 and grinding slurry 16. The lower base plate 11 is opposite to the upper base plate 14. The adsorption sheet 12 adheres onto the lower base plate 11 by use of an adhesive layer 17, and the adsorption sheet 12 is used for carrying and fixing the polishing workpiece 13. The polishing workpiece 13 is selected from a group consisting of a semiconductor, a storage medium substrate, an integrated circuit, LCD flat panel glass, optical glass and a photoelectric panel. The polishing pad 15 is fixed to the upper base plate 14. For example, the polishing pad 15 adheres onto the upper base plate 14 by use of an adhesive layer 18. The polishing pad 15 faces the lower base plate 11, for polishing the polishing workpiece 13.

The operation mode of the grinding device 1 is as follows. At first, the polishing workpiece 13 is placed on the adsorption sheet 12, and the polishing workpiece 13 is adsorbed by the adsorption sheet 12. Next, the upper base plate 14 and the lower base plate 11 rotate in opposite directions, and the upper base plate 14 is moved downward, so that a grinding surface 223 of the polishing pad 15 contacts a surface of the polishing workpiece 13, and the polishing workpiece 13 can be polished by means of continuous supplement of the grinding slurry 16 and the action of the polishing pad 15.

Figure 2:
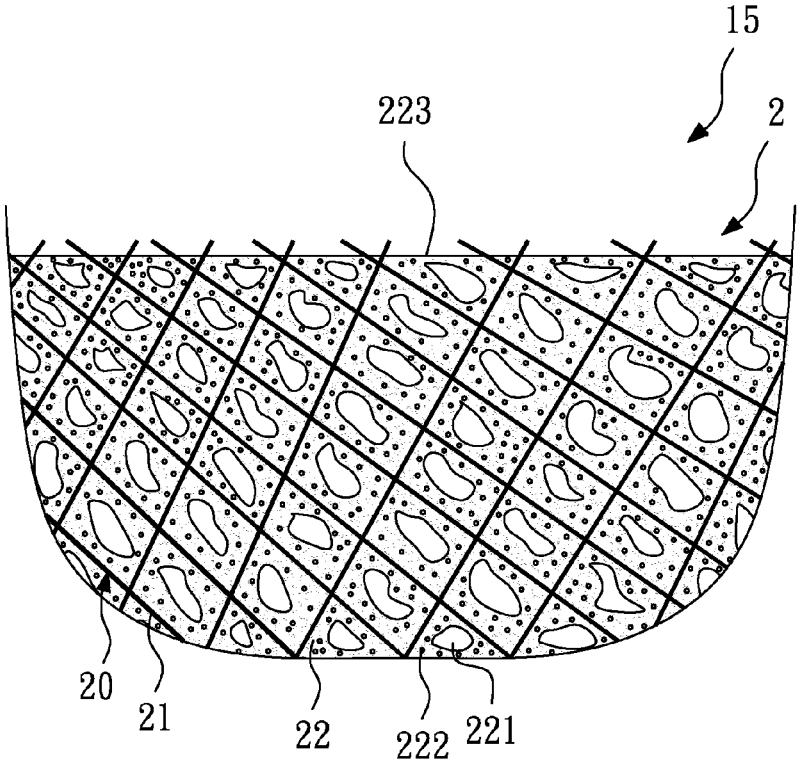
FIG. 2 is a schematic partially enlarged cross-sectional view of an embodiment of a polishing pad according to the present invention.

FIG. 2 is a schematic partially enlarged cross-sectional view of an embodiment of a polishing pad according to the present invention. The polishing pad 15 may be a single-layer structure or a multi-layer structure. In this embodiment, the polishing pad 15 is a single-layer structure, and has a grinding layer 2. The grinding layer 2 includes a plurality of fibers 21 and a main body 22. The fibers 21 cross each other to form a fiber substrate 20, and the fineness of the fibers 21 is 0.001 den to 6 den. The material of the fibers 21 is selected from a group consisting of Polyamide Resin, Polyethylene Terephthalate (PET), Nylon, Polyproylene (PP), Polyester Resin, Acrylic Resin, Polyacrylonitrile Resin and composites thereof. Preferably, the fibers 21 are short fibers, the length thereof is 30 to 100 mm, and the fiber substrate 20 is a non-woven fabric. The density of the fiber substrate 20 is preferably 0.05 to 0.30 g/cm$^3$.

The main body 22 is a foam and encloses the fibers 21. In this embodiment, the main body 22 is a separate foam, which is a resin composition or copolymer, and the material thereof includes a first component and a second component. The first component is polyuisocyanate, and preferably, the polyuisocyanate is toluene diisocyanate (TDI) or diphenylmethane diisocyanate (MDI). The second component is a foaming agent, and preferably, the foaming agent is polyol. Preferably, the material of the main body 22 further includes a cross-linking hardener, for accelerating hardening of the main body 22. The cross-linking hardener may be aliphatic amine, alicyclic amine, amide amine or dicyandiamide. The main body 22 has a plurality of first pores 221 and a plurality of second pores 222. The first pores 221 are communicated with each other, the second pores 222 are independent from each other, and the size of the first pores 221 is at least 5 times, preferably at least 10 times, greater than the size of the second pores 222. In this embodiment, the size of the first pores 221 is 1 to 3 mm, and the size of the second pores 222 is 100 to 300 μm. The first pores 221 are physical pores, which are naturally formed in a space located between the fibers 21 after the raw material of the main body 22 encloses the fibers 21, and the fibers 21 are not exposed in the first pores 221. That is, the first pores 221 are not pores formed by foaming or impregnation or other chemical processing means. The second pores 222 are foaming pores, which are formed through a foaming process of the raw material of the main body 22.

The hardness of the grinding layer 2 is 30 to 90 shore D, and preferably is 40 to 70 shore D. The compression ratio of the grinding layer 2 is 1% to 10%, and preferably is 2% to 5%. As shown in FIG. 2, the main body 22 has a grinding surface 223, and a portion of the fibers 21 protrude from the grinding surface 223.

Figure 3:
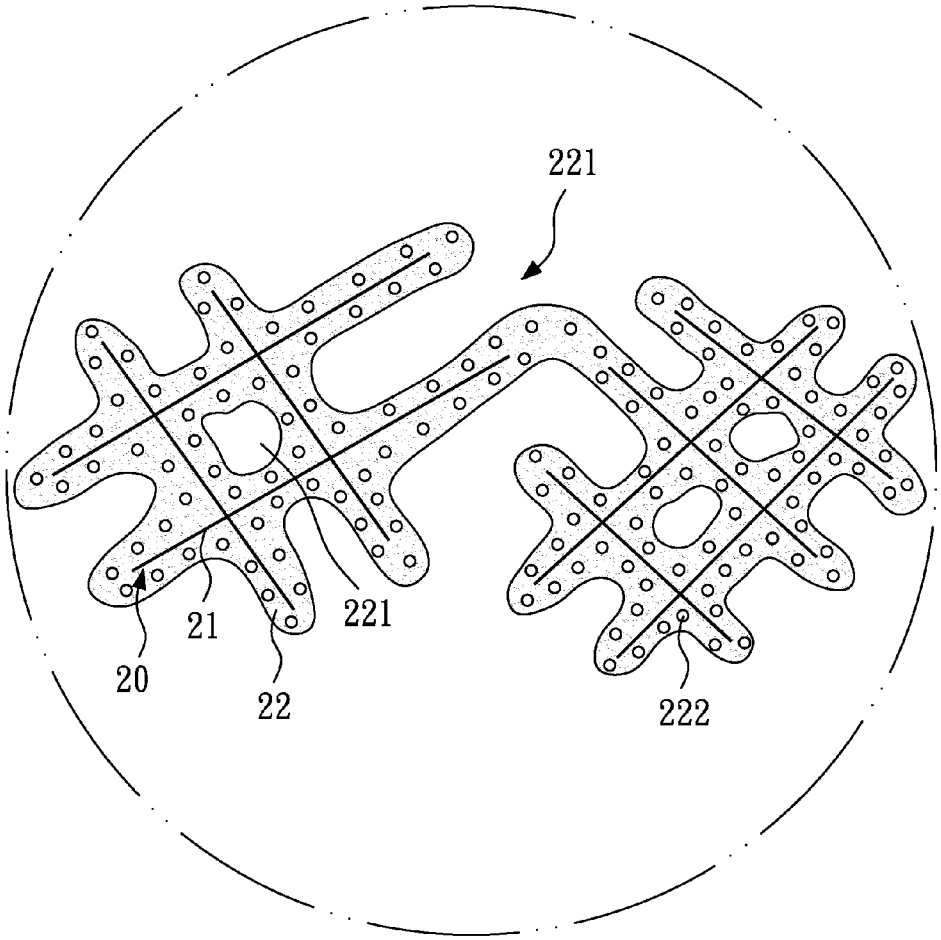
FIG. 3 is a schematic partially enlarged cross-sectional view of another embodiment of the polishing pad according to the present invention.
Figure 4:
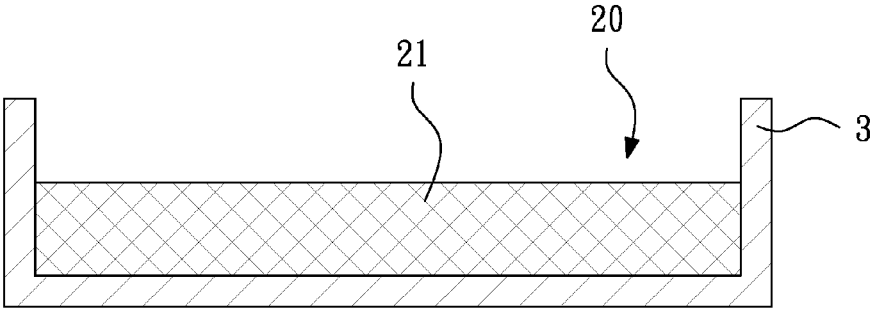
FIG. 4 to FIG. 8 are schematic views of an embodiment of a method for making a polishing pad according to the present invention.

FIG. 3 is a schematic partially enlarged cross-sectional view of another embodiment of the polishing pad according to the present invention. In this embodiment, the fibers 21 are completely enclosed by the main body 22, that is, two ends of each of the fibers 21 are completely enclosed by the main body 22, so that the fibers 21 are not exposed in the first pores 221.

In the present invention, the hardness and the strength (rigidity) of the grinding layer 2 are moderate, and thus the grinding surface 223 has preferable planarization performance, which makes it difficult to scratch the polishing workpiece 13, and has a longer service life.

FIG. 4 to FIG. 8 are schematic views of an embodiment of a method for making a polishing pad according to the present invention. The method for making a polishing pad includes the following steps. First, referring to FIG. 4, a fiber substrate 20 is provided, which is formed of a plurality of fibers 21 crossing each other. The fineness of the fibers 21 is 0.001 den to 6 den. The material of the fibers 21 is selected from a group consisting of Polyamide Resin, Polyethylene Terephthalate (PET), Nylon, Polyproylene (PP), Polyester Resin, Acrylic Resin, Polyacrylonitrile Resin and composites thereof. Preferably, the fibers 21 are short fibers, the length thereof is 30 to 100 mm, and the fiber substrate 20 is a non-woven fabric. The weight of the fiber substrate 20 is 350 g/m$^2$ to 1000 g/m$^2$, and the density thereof is preferably 0.05 to 0.30 g/cm$^3$.

Next, the fiber substrate 20 is placed in a mold 3. In this embodiment, the mold 3 is box-like, which has a length, a width and a depth.

Then, a foaming resin is provided. In this embodiment, the foaming resin is a resin composition or copolymer, and the material thereof includes a first component and a second component. The first component is polyuisocyanate, and preferably, the polyuisocyanate is toluene diisocyanate (TDI) or diphenylmethane diisocyanate (MDI). The second component is a foaming agent, and preferably, the foaming agent is polyol. Preferably, the material of the foaming resin further includes a cross-linking hardener, for accelerating hardening of the foaming resin. The cross-linking hardener may be aliphatic amine, alicyclic amine, amide amine or dicyandiamide. In the meantime, raw materials (that is, the first component and the second component) of the foaming resin are mixed and stirred to form the foaming resin with a proper viscosity, and preferably, the viscosity of the foaming resin is 2000 cps to 5000 cps.

Figure 5:
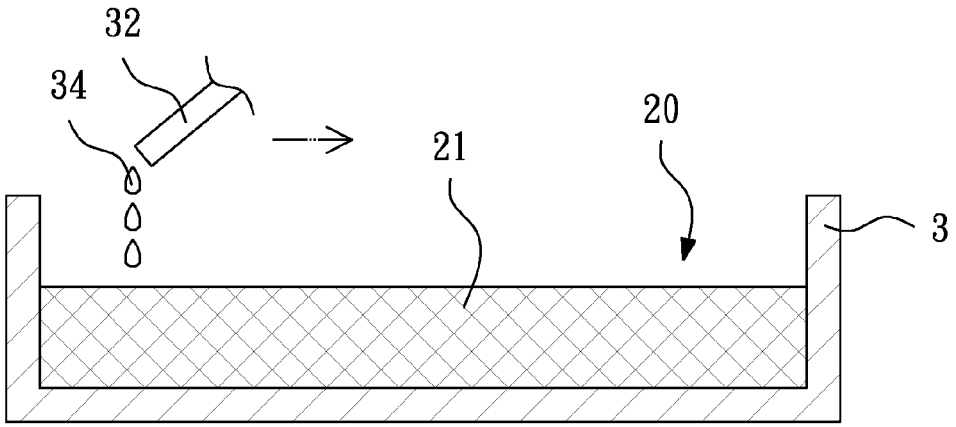

Referring to FIG. 5, the foaming resin 34 is injected into the mold 3 to permeate the fiber substrate 20 to enclose the fibers 21, until the fiber substrate 20 has been fully immersed in the foaming resin 34. At this time, the foaming resin 34, after permeating the fiber substrate 20, forms a plurality of first pores 221 (FIG. 2 and FIG. 3). The first pores 221 are physical pores, which are naturally formed in a space located between the fibers 21 after the foaming resin encloses the fibers 21, and the fibers 21 are not exposed in the first pores 221. That is, the first pores 221 are not pores formed by foaming or impregnation or other chemical processing means. In this embodiment, the foaming resin 34 enters the fiber substrate 20 by means of injection or dripping through an injection head 32, that is, the foaming resin 34 downward permeates the fiber substrate 20 from a location above the fiber substrate 20 due to gravity, which is different from the conventional impregnation process. Preferably, the injection head 32 moves in this process, so that the foaming resin 34 is more uniformly distributed in the fiber substrate 20.

Figure 6:
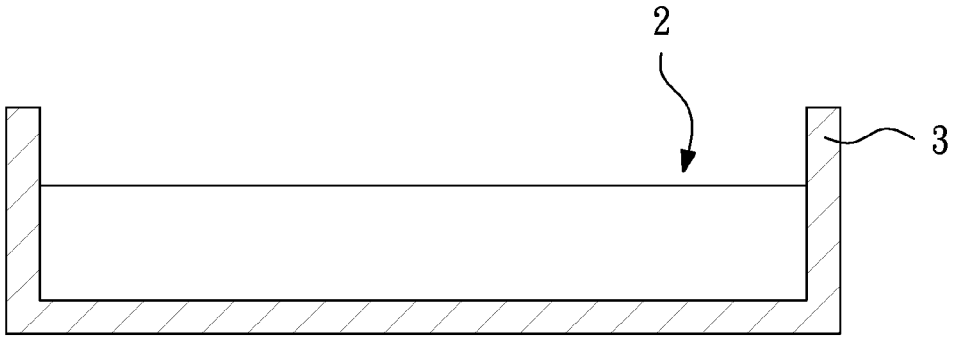

Referring to FIG. 6, the foaming resin is cured through heating, so as to form a grinding layer 2, the grinding layer 2 including the fiber substrate 20 and a main body 22 (FIG. 2), wherein the main body 20 is a foam formed by curing the foaming resin 34, and encloses the fibers 21. At this time, after the foaming resin 34 is heated, nitrogen ($N_2$) or carbon dioxide ($CO_2$) therein escapes, and a plurality of second pores 222 is formed. That is, the second pores are foaming pores, which are formed by the raw material (the foaming resin 34) of the main body 22 through a foaming process. Therefore, the main body 22 has the first pores 221 and the second pores 222, the first pores 221 are communicated with each other, the second pores 222 are independent from each other, and the size of the first pores 221 is at least 5 times greater than the size of the second pores 222, wherein the hardness of the grinding layer 2 is 30 to 90 shore D, and the compression ratio thereof is 1% to 10%.

In this embodiment, the heating and curing process includes two stages: the first stage is a pre-aging step, and the second stage is a hardening and aging step. The pre-aging step is directly heating the foaming resin 34 and the fiber substrate 20 in the mold 3 to form the grinding layer 2. Next, the hardening and aging step is taking the grinding layer 2 out from the mold 3 and then placing the grinding layer 2 in an oven or an aging chamber for a long period of time, so as to make the property of the main body 22 (the foaming resin 34) more stable.

Figure 7:
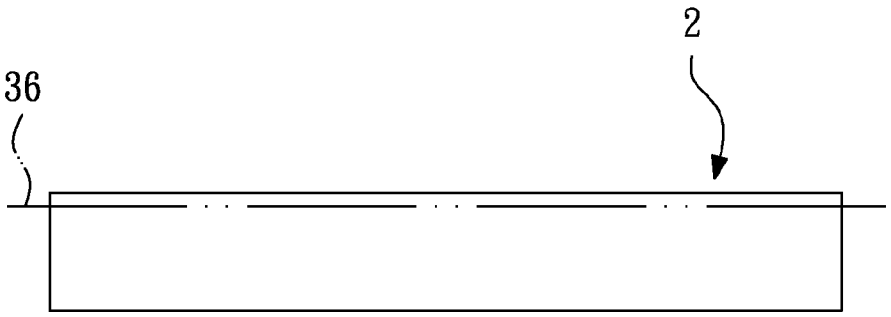
Figure 8:
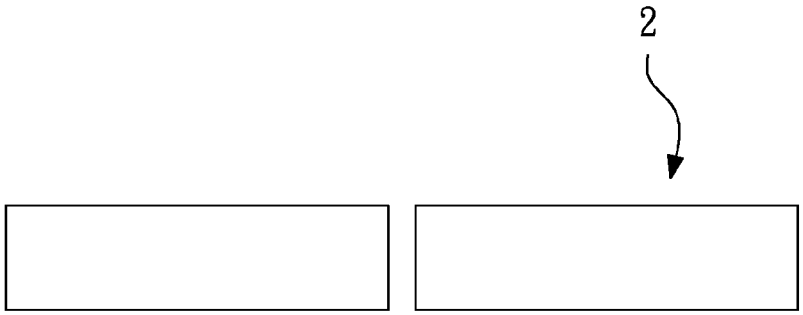

Referring to FIG. 7 and FIG. 8, a slicing step is performed, so that a portion of the fibers 21 protrude from a surface of the main body 22, so as to manufacture the polishing pad 15 shown in FIG. 1 to FIG. 3. In this embodiment, the slicing step includes two stages: the first stage is transverse slicing, and the second stage is longitudinal slicing. Referring to FIG. 7, the transverse slicing step is shown, and in this step, a cutting tool (not shown in the drawing) removes an upper portion of the grinding layer 2 along a horizontal direction (as shown by a cutting line 36), so as to reduce the thickness of the grinding layer 2 to expose a portion of the fibers 21 and form the grinding surface 223 (FIG. 2). It can be understood that other trimming apparatuses can also be used to remove the upper portion of the grinding layer 2. Referring to FIG. 8, the longitudinal slicing step is shown, and in this step, a cutting tool (not shown in the drawing) cuts the grinding layer 2 into a plurality of portions of a desired size along a vertical direction.

Preferably, next, an adhesive layer 18 is pasted on the back surface of the grinding layer 2, so as to facilitate adhesion of the grinding layer 2 onto the upper base plate 14 (FIG. 1).

Examples are given below to describe the present invention in detail, but it does not mean that the present invention is only limited to content disclosed in the examples.

EXAMPLE 1

First, a non-woven fiber substrate having a thickness of 5.0 mm is provided, whose weight is 950 g/m$^2$ and density is 0.19 g/cm$^3$. The material of fibers of the non-woven substrate is 100% of PET, and the fineness thereof is 1.50 den.

Next, the fiber substrate is placed in a mold, and in this embodiment, the length, the width and the depth of the mold are respectively 100 cm, 100 cm and 1 cm.

Then, diisocyanate (TDI component) with 78.00 wt % and an equivalent number of 200-450 and polyol with 22.00 wt % and an equivalent number of 50-250 are fully mixed to form a foaming resin. In the meantime, the foaming resin is mixed and stirred to form a polymer solution with viscosity of 2250 cps.

Next, the polymer solution of the foaming resin is injected into the mold to permeate the fiber substrate to enclose the fibers.

Then, a pre-aging step is performed, in which the foaming resin and the fiber substrate in the mold are directly heated to 70□, which is maintained for 60 minutes, so as to form the grinding layer. Next, a hardening and aging step is performed, in which the grinding layer is taken out from the mold and then placed in an aging chamber for 12 hours, wherein the temperature of the aging chamber is 70□. The hardness of the grinding layer in the example is 40 shore D, and the compression ratio thereof is 5.33%.

Next, a slicing step is performed, so as to expose a portion of fibers, and the grinding layer is cut into a plurality of portions of a desired size. Afterwards, an adhesive layer is pasted onto the back surface of the grinding layer.

EXAMPLE 2

First, a non-woven fiber substrate having a thickness of 4.5 mm is provided, whose weight is 675 g/m$^2$ and density is 0.19 g/cm$^3$. The material of fibers of the non-woven substrate is 60% of PET and 40% of Nylon, and the fineness thereof is 3.0 den.

Next, the fiber substrate is placed in a mold, and in this example, the length, the width and the depth of the mold are respectively 90 cm, 170 cm and 5 cm.

Then, diisocyanate (TDI component) with 74.20 wt % and an equivalent number of 200-450, a cross-linking hardener with 20.81 wt % and an equivalent number of 50-250 and polyol with 4.99 wt % and an equivalent number of 50-150 are fully mixed to form a foaming resin. In the meantime, the foaming resin is mixed and stirred to form a polymer solution with viscosity of 3600 cps.

Next, the polymer solution of the foaming resin is injected into the mold to permeate the fiber substrate to enclose the fibers.

Then, a pre-aging step is performed, in which the foaming resin and the fiber substrate in the mold are directly heated to 80□, which is maintained for 75 minutes, so as to form the grinding layer. Next, a hardening and aging step is performed, in which the grinding layer is taken out from the mold and then placed in an aging chamber for 14 hours, wherein the temperature of the aging chamber is 80□. The hardness of the grinding layer in the example is 45 shore D, and the compression ratio thereof is 2.42%.

Next, a slicing step is performed, so as to expose a portion of fibers, and the grinding layer is cut into a plurality of portions of a desired size. Afterwards, an adhesive layer is pasted onto the back surface of the grinding layer.

EXAMPLE 3

First, a non-woven fiber substrate having a thickness of 3.0 mm is provided, whose weight is 390 g/m$^2$ and density is 0.13 g/cm$^3$. The material of fibers of the non-woven substrate is 50% of PET and 50% of PP, and the fineness thereof is 2.5 den.

Next, the fiber substrate is placed in a mold, and in this embodiment, the length, the width and the depth of the mold are respectively 110 cm, 110 cm and 5 cm.

Then, diisocyanate (TDI component) with 68.90 wt % and an equivalent number of 200-450, aliphatic amine with 28.57 wt % and an equivalent number of 50-250 and polyol with 2.53 wt % and an equivalent number of 50-150 are fully mixed to form a foaming resin. In the meantime, the foaming resin is mixed and stirred to form a polymer solution with viscosity of 4400 cps.

Next, the polymer solution of the foaming resin is injected into the mold to permeate the fiber substrate to enclose the fibers.

Then, a pre-aging step is performed, in which the foaming resin and the fiber substrate in the mold are directly heated to 70□, which is maintained for 80 minutes, so as to form the grinding layer. Next, a hardening and aging step is performed, in which the grinding layer is taken out from the mold and then placed in an aging chamber for 16 hours, wherein the temperature of the aging chamber is 70□. The hardness of the grinding layer in the example is 50 shore D, and the compression ratio thereof is 1.36%.

Next, a slicing step is performed, so as to expose a portion of fibers, and the grinding layer is cut into a plurality of portions of a desired size. Afterwards, an adhesive layer is pasted onto the back surface of the grinding layer.

The above embodiments only describe the principle and the efficacies of the present invention, and are not used to limit the present invention. Therefore, modifications and variations of the embodiments made by persons skilled in the art do not depart from the spirit of the invention. The scope of the present invention should fall within the scope as defined in the appended claims.

What is claimed is:

1. A polishing pad having a grinding layer, the grinding layer comprising:

a plurality of fibers crossing each other to form a fiber substrate, the fineness of the fibers being 0.001 den to 6 den; and a main body being a foam and enclosing the fibers, the main body having a plurality of first pores and a plurality of second pores, the first pores being communicated with each other, the second pores being independent from each other, and the size of the first pores being at least 5 times greater than the size of the second pores, wherein the hardness of the grinding layer is 30 to 90 shore D, and the compression ratio thereof is 1% to 10%, wherein the first pores are physical pores, and the second pores are foaming pores.

2. The polishing pad according to claim 1, wherein the density of the fiber substrate is 0.05 to 0.30 g/cm$^3$, and the material of the main body comprises a first component and a second component, the first component being polyuisocyanate, and the second component being a foaming agent.

3. The polishing pad according to claim 1, wherein the main body has a grinding surface, and a portion of the fibers protrude from the grinding surface.

4. The polishing pad according to claim 1, wherein the size of the first pores is at least 10 times greater than the size of the second pores, wherein the hardness of the grinding layer is 40 to 70 shore D, and the compression ratio thereof is 2% to 5%.

5. The polishing pad according to claim 1, wherein the material of the fibers is selected from a group consisting of Polyamide Resin, Polyethylene Terephthalate (PET), Nylon, Polyproylene (PP), Polyester Resin, Acrylic Resin, Polyacrylonitrile Resin and composites thereof.

6. The polishing pad according to claim 1, wherein the fibers are completely enclosed by the main body, and are not exposed in the first pores.

* * * * *